US008116673B2

(12) United States Patent
Yoon et al.

(10) Patent No.: US 8,116,673 B2
(45) Date of Patent: Feb. 14, 2012

(54) PRINTING MEDIUM SUPPLYING UNIT AND IMAGE FORMING APPARATUS HAVING THE SAME

(75) Inventors: Hyung-Won Yoon, Seongnam-Si (KR); Hyun-Ki Cho, Hanam-Si (KR); Tae-Hee Kim, Incheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 918 days.

(21) Appl. No.: 12/124,350

(22) Filed: May 21, 2008

(65) Prior Publication Data

US 2009/0022537 A1 Jan. 22, 2009

(30) Foreign Application Priority Data

Jul. 20, 2007 (KR) ..... 10-2007-0073030

(51) Int. Cl.
*B65H 3/06* (2006.01)

(52) U.S. Cl. ..... 399/393; 271/118

(58) Field of Classification Search ..... 399/393; 271/118

See application file for complete search history.

(56) References Cited

U.S. PATENT DOCUMENTS 4,319,740 A * 3/1982 Ulseth ..... 271/22
6,341,774 B1 * 1/2002 Ueda ..... 271/119
6,443,445 B1 * 9/2002 Bortolotti ..... 271/117
7,364,152 B2 * 4/2008 Suwa ..... 271/118
2005/0236760 A1 * 10/2005 Kang ..... 271/152
2006/0033258 A1 2/2006 Lim et al.
2006/0197276 A1 9/2006 Tanaka

FOREIGN PATENT DOCUMENTS

EP 1681252 7/2006
JP 55135033 A * 10/1980
JP 04085217 A * 3/1992
JP 11130276 A * 5/1999
KR 10-2006-0045309 5/2006

OTHER PUBLICATIONS

European Search Report issued Dec. 6, 2010 in EP Application No. 08160547.9.

Office Action issued in Korean Patent Application No. 10-2007-0073030 on Nov. 30, 2011.

* cited by examiner

*Primary Examiner* — Judy Nguyen
*Assistant Examiner* — Nguyen Q Ha
(74) *Attorney, Agent, or Firm* — Stanzione & Kim, LLP

(57) ABSTRACT

A printing medium supplying unit comprises a printing medium loading plate configured to move up and down based on an amount of printing medium loaded on the printing medium loading plate and an elevation control unit configured to adjust an elevation height of the printing medium loading plate such that a standby position of the printing medium loading plate can vary based on an amount of the printing medium loaded on the printing medium loading plate, wherein the standby position of the printing medium loading plate is a position in which the printing medium loading plate does not supply the printing medium to an image forming unit.

19 Claims, 14 Drawing Sheets

PRINTING MEDIUM SUPPLYING UNIT AND IMAGE FORMING APPARATUS HAVING THE SAME

CROSS-REFERENCE TO RELATED APPLICATIONS

This application claims priority from Korean Patent Application No. 10-2007-0073030, filed on Jul. 20, 2007, in the Korean Intellectual Property Office, the disclosure of which is incorporated herein by reference in its entirety.

BACKGROUND OF INVENTION

1. Field of Invention

The present disclosure relates to a printing medium supplying unit and an image forming apparatus having the same and, more particularly, to a printing medium supplying unit capable of adjusting the height of a printing medium loading component.

2. Description of Related Art

An image forming apparatus includes a printing medium supplying unit, an image forming unit, and a discharging unit. The printing medium supplying unit may be configured to supplying the printing medium to an image forming unit. This printing medium may include, for example, paper, transparent sheets, cardboard, or any other material on which an image may be formed. The image forming unit may be configured to forming an image on the printing medium. This image forming unit may include, for example, a photoreceptor. The photoreceptor may be in the form of a drum assembly made of photoconductive material on which a representation of an image can be formed by light. The image forming unit may form the image on the printing medium supplied from the printing medium supplying unit. The discharging unit may be configured to discharge the printing medium to an external unit once the image is formed on the printing medium.

FIGS. 1A and 1B are perspective views illustrating an operation of a conventional printing medium supplying unit 10. As shown therein, the conventional printing medium supplying unit 10 includes a feeding cassette 30, a printing medium loading plate 31, a pickup roller 20, and a cam member 23. The printing medium loading plate 31 moves up and down inside the feeding cassette 30 and allows a printing medium to be loaded thereon. The pickup roller 20 picks up the printing medium from the printing medium loading plate 31. The cam member 23 is coaxially located with a rotation shaft 21 of the pickup roller 20. The cam member 23 is configured to press or release the printing medium loading plate 31 so as to move the printing medium loading plate 31 down or up, respectively.

In FIG. 1A, if a printing signal is not applied, the cam member 23 presses the printing medium loading plate 31 to separate the pickup roller 20 from the printing medium. On the other hand, as shown in FIG. 1B, if the printing signal is applied, the rotation shaft 21 rotates and the pressure applied against the printing medium loading plate 31 is withdrawn. Accordingly, the printing medium loading plate 31 moves up toward the pickup roller 20. The pickup roller 20 then picks up the printing medium and transfers the printing medium toward an image forming unit (not shown). Once the pickup roller 20 has picked up the printing medium, the cam member 23 once again presses the printing medium loading plate 31 to move the printing medium loading plate 31 down.

While the conventional printing medium supplying unit 10 may be used to provide a printing medium to an image forming unit, the unit 10 suffers from various shortcomings. For example, as shown in FIG. 2, in the conventional printing medium supplying unit 10, a length l of a cam profile 23*a* is uniform along an axial line of the rotation shaft 21. This uniform length l of the cam profile 23*a* causes the height at which the printing medium loading plate 31 is maintained to be uniform irrespective of the amount of the printing medium loaded on the printing medium loading plate 31. Accordingly, if the amount of the printing medium loaded on the printing medium loading plate 31 is reduced, the speed of elevation of the printing medium loading plate 31 released from the pressing force increases. This increase in the elevation speed of the printing medium loading plate 31 may cause a loud noise upon impact when the printing medium loading plate 31 comes in contact with the pickup roller 20. This impact noise is one of the noises most often heard when using an image forming apparatus that includes the conventional printing medium supplying unit 10.

Furthermore, when the printing medium loading plate 31 is elevated at a high speed, the contact area 33 of the printing medium loading plate 31 that comes in contact with the cam member 23 may be damaged due to the impact. The present disclosure is directed towards overcoming one or more shortcomings of the conventional printing medium supplying unit 10.

SUMMARY OF INVENTION

One aspect of the present disclosure includes a printing medium supplying unit. The unit comprises a printing medium loading plate configured to move up and down, and on which an amount of printing medium may be loaded and an elevation control unit configured to adjust an elevation height of the printing medium loading plate to vary a standby position of the printing medium loading plate based on the amount of the printing medium loaded on the printing medium loading plate, wherein the standby position of the printing medium loading plate is a position of the printing medium loading plate when the printing medium is not being supplied from the printing medium supplying unit.

Another aspect of the present disclosure includes an image forming apparatus. The apparatus comprises a printing medium supplying unit. The printing medium supplying unit comprises a printing medium loading plate configured to move up and down, and on which an amount of printing medium may be loaded and an elevation control unit configured to adjust an elevation height of the printing medium loading plate to vary a standby position of the printing medium loading plate based on the amount of the printing medium loaded on the printing medium loading plate, wherein the standby position of the printing medium loading plate is a position of the printing medium loading plate when the printing medium to an image forming unit. The apparatus also comprises an image forming unit configured to form an image on a printing medium supplied from the printing medium supplying unit and a printing medium discharging unit configured to discharge the printing medium on which the image is formed.

BRIEF DESCRIPTION OF DRAWINGS

These and/or other features of the present disclosure will become apparent and more readily appreciated from the following description of the exemplary embodiments, taken in conjunction with the accompanying drawings, in which.

DETAILED DESCRIPTION OF EXEMPLARY EMBODIMENTS OF INVENTION

Figure 1A:
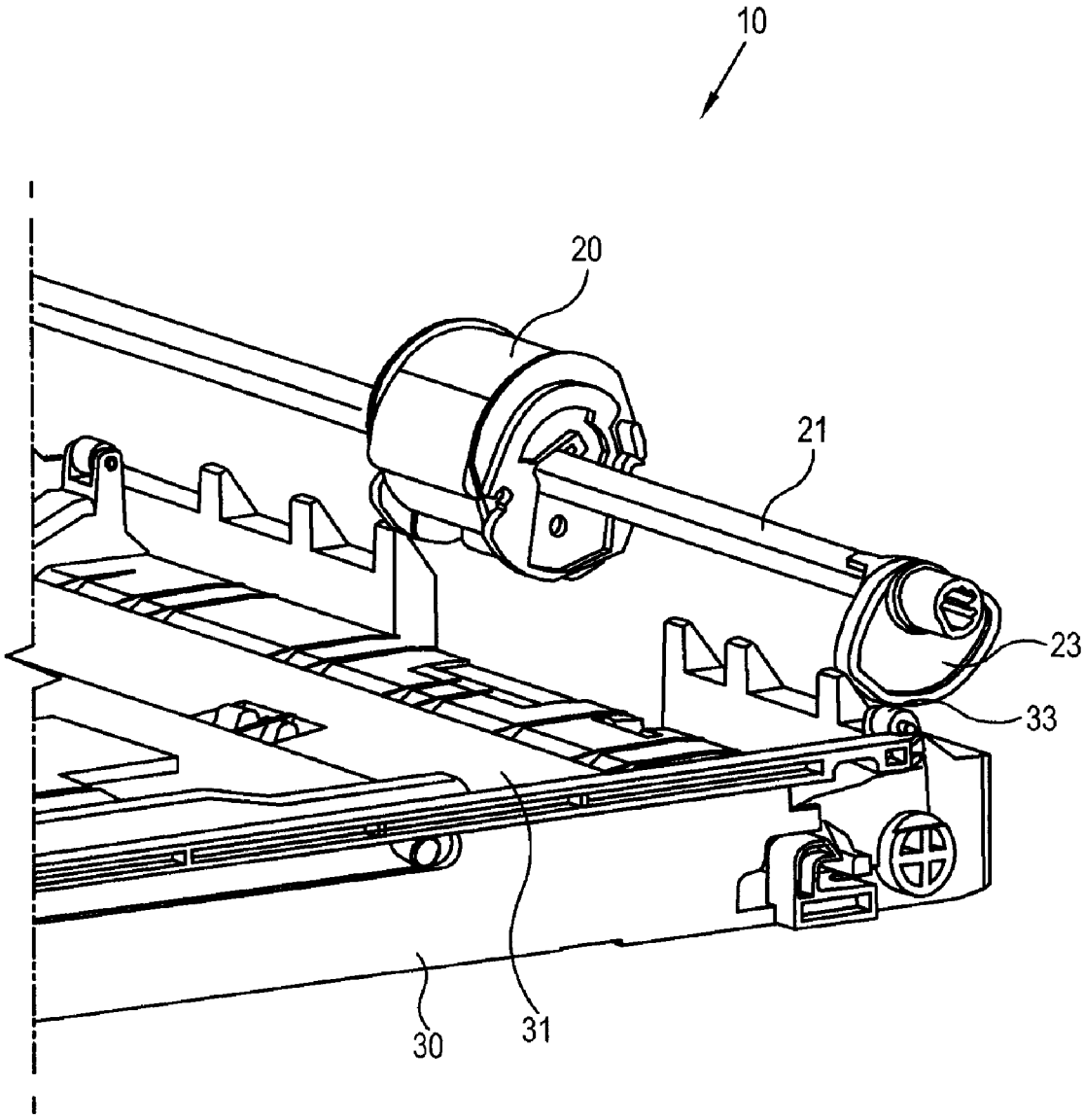
FIGS. 1A and 1B are perspective views illustrating an operating process of a conventional printing medium supplying unit.
Figure 1B:
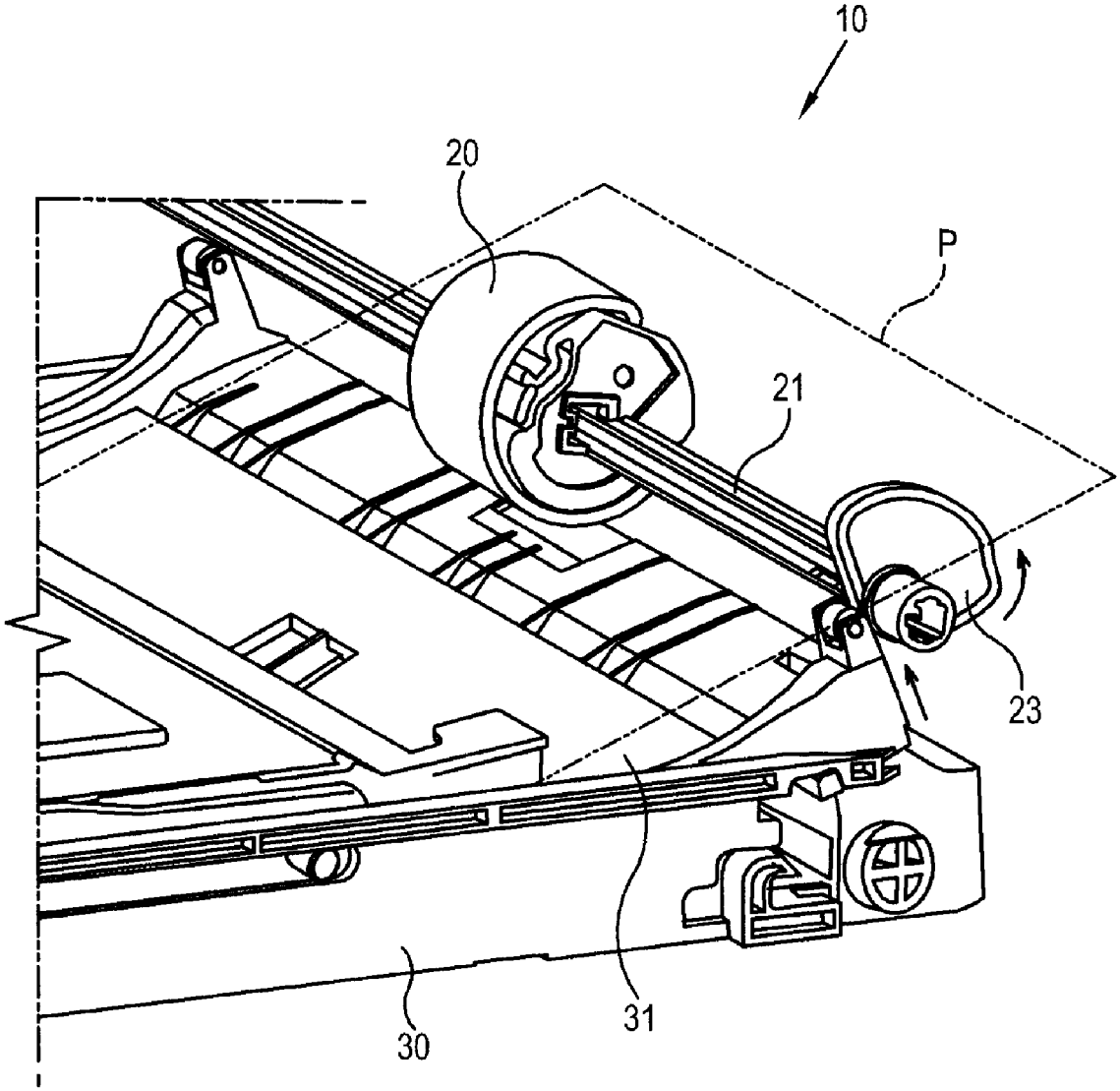
Figure 2:
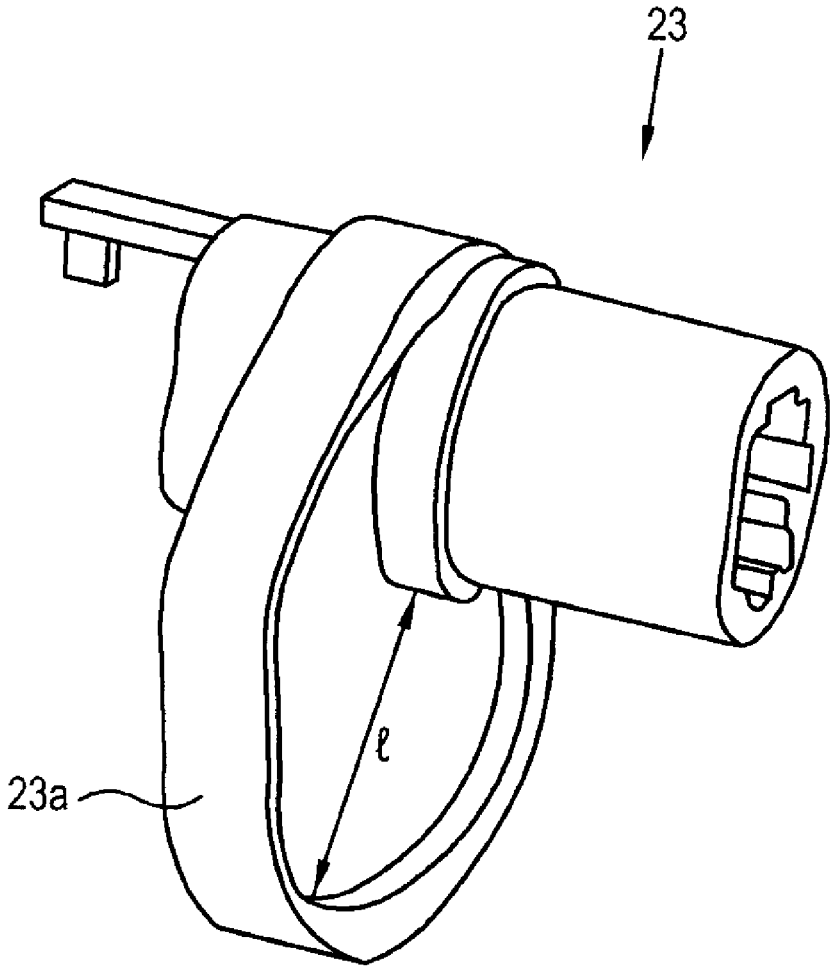
FIG. 2 is a perspective view illustrating a cam configuration of the conventional printing medium supplying unit.

Reference will now be made in detail to the embodiments of the present disclosure, examples of which are illustrated in the accompanying drawings, wherein like reference numerals refer to like elements throughout.

Figure 3A:
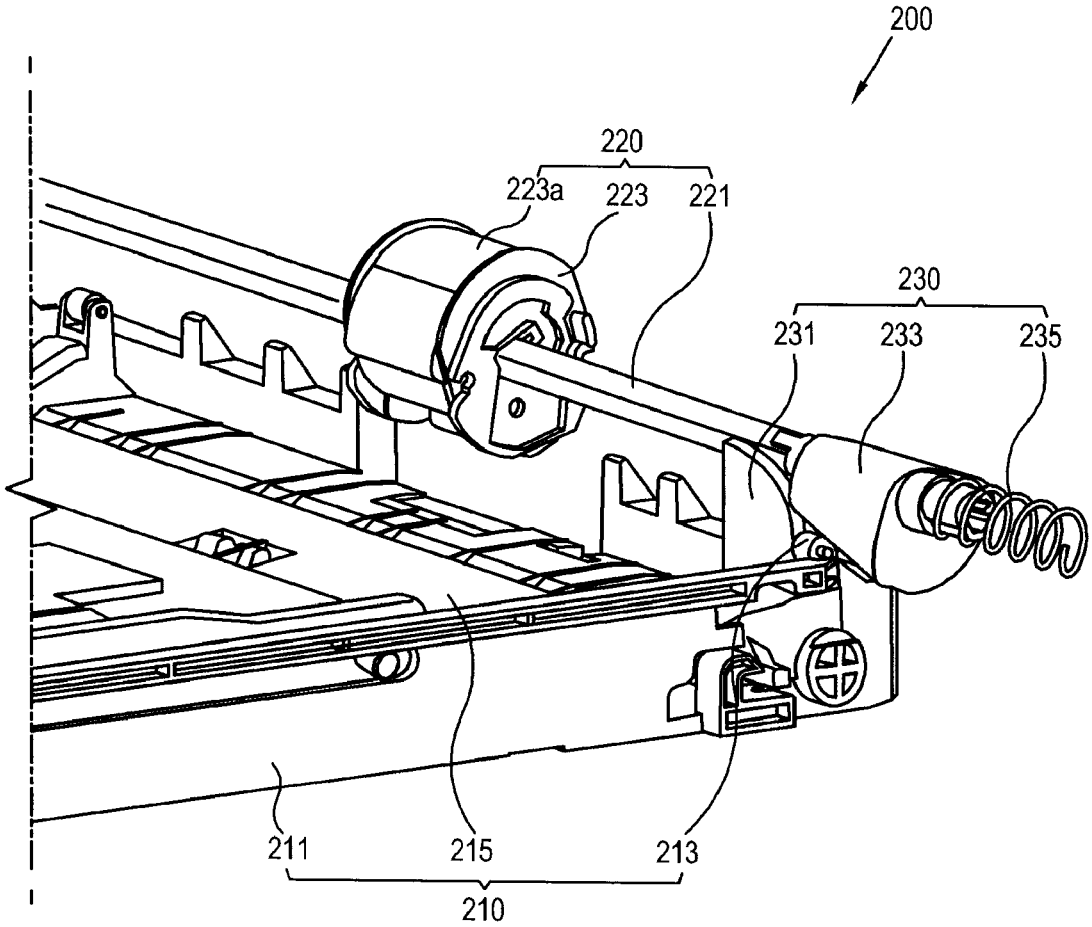
FIGS. 3A and 3B are perspective views illustrating a configuration of a printing medium supplying unit according to an exemplary disclosed embodiment.
Figure 3B:
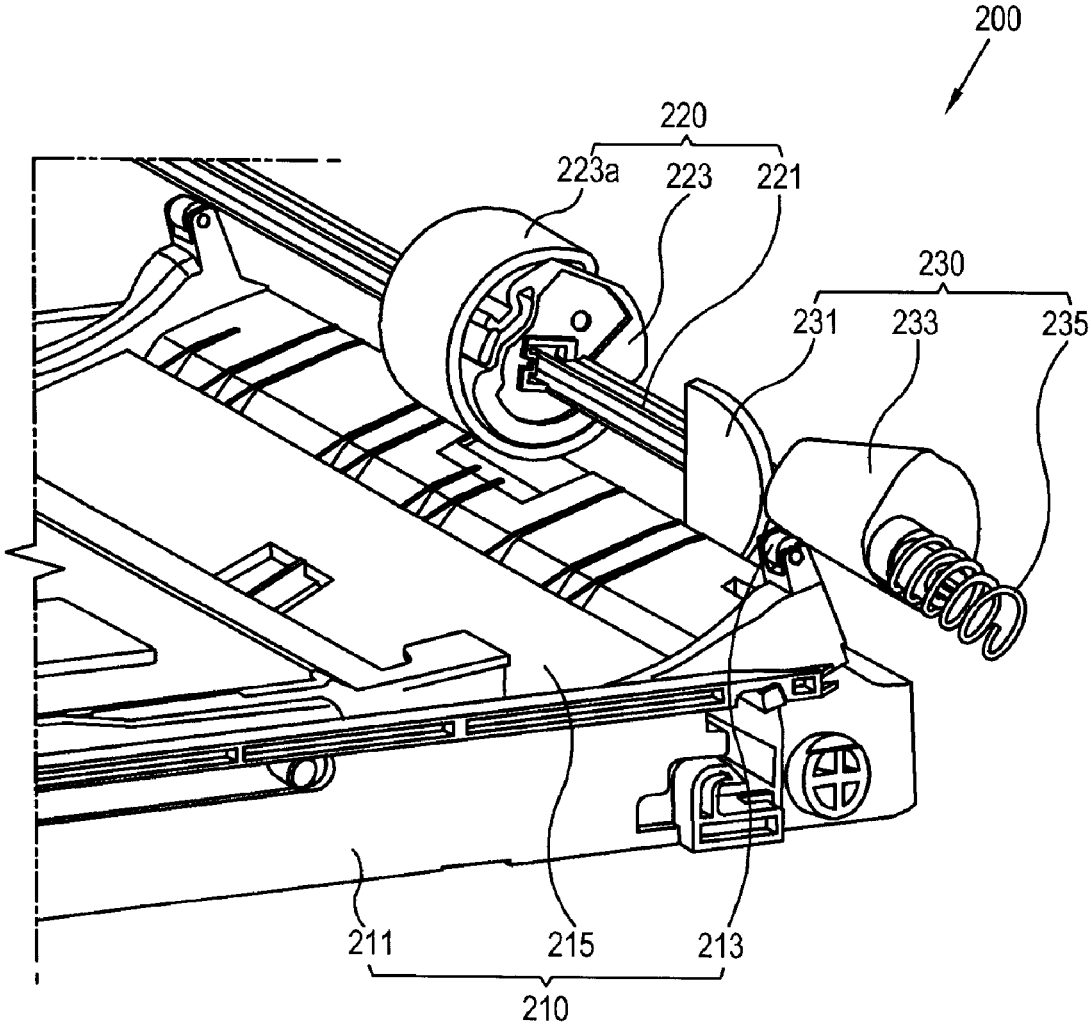

FIGS. 3A and 3B are perspective views illustrating a configuration of a printing medium supplying unit 200 according to an exemplary disclosed embodiment. As shown therein, the printing medium supplying unit 200 includes a cassette unit 210, a pickup unit 220, and an elevation control unit 230. The cassette unit 210 accommodates a printing medium loading plate 215 in which a printing medium is loaded. The pickup unit 220 picks up the printing medium loaded in the printing medium loading plate 215 and provides the picked up printing medium to an image forming unit. The elevation control unit 230 adjusts an elevation height of the printing medium loading plate 215. This elevation height may be adjusted depending on the amount of printing medium loaded in the printing medium loading plate 215. Furthermore, the elevation height is adjusted so that the pickup unit 220 can pick up the printing medium.

The cassette unit 210 includes a cassette main body 211. The main body 211 accommodates the printing medium that is loaded on the printing medium loading plate 215. The printing medium loading plate 215 is configured to move up and down between a standby position and a supply position inside the cassette main body 211. The printing medium loading plate 215 includes an upper surface on which the printing medium is loaded. The cassette unit 210 also includes an elevation adjusting elastic member (not shown) provided between the printing medium loading plate 215 and the cassette main body 211. The elevation adjusting elastic member may be configured to supply an elastic force to raise the printing medium loading plate 215 to a supply position to supply the printing medium to the pickup unit 220.

Figure 4:
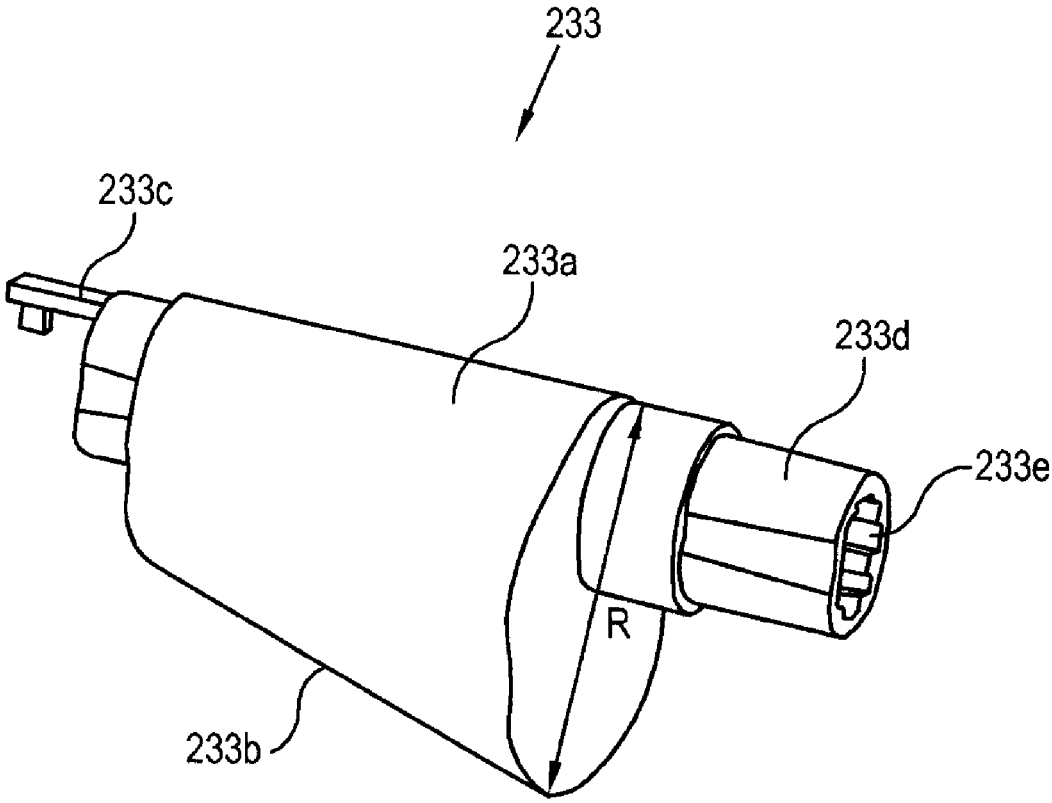
FIG. 4 is a perspective view illustrating a configuration of an external force receiving unit according to an exemplary disclosed embodiment.

The printing medium loading plate 215 is provided to move up and down between a standby position and a supply position. As shown in FIG. 3A, the standby position is one in which the printing medium loading plate 215 is distanced from a pickup roller 223. As shown in FIG. 3B, the supply position is one in which the printing medium loading plate 215 moves up to the pickup roller 223 so that the printing medium can come in contact with the pickup roller 223. In addition, a side of the printing medium loading plate 215 is provided with a contact member 213 that protrudes from a bottom surface. The contact member 213 may be configured to come in contact with and be separated from an external force receiving unit 233 (as shown in FIG. 4). The contact member 213 may beneficially include an idle roller driven by rotation of the external force receiving unit 233.

Figure 6A:
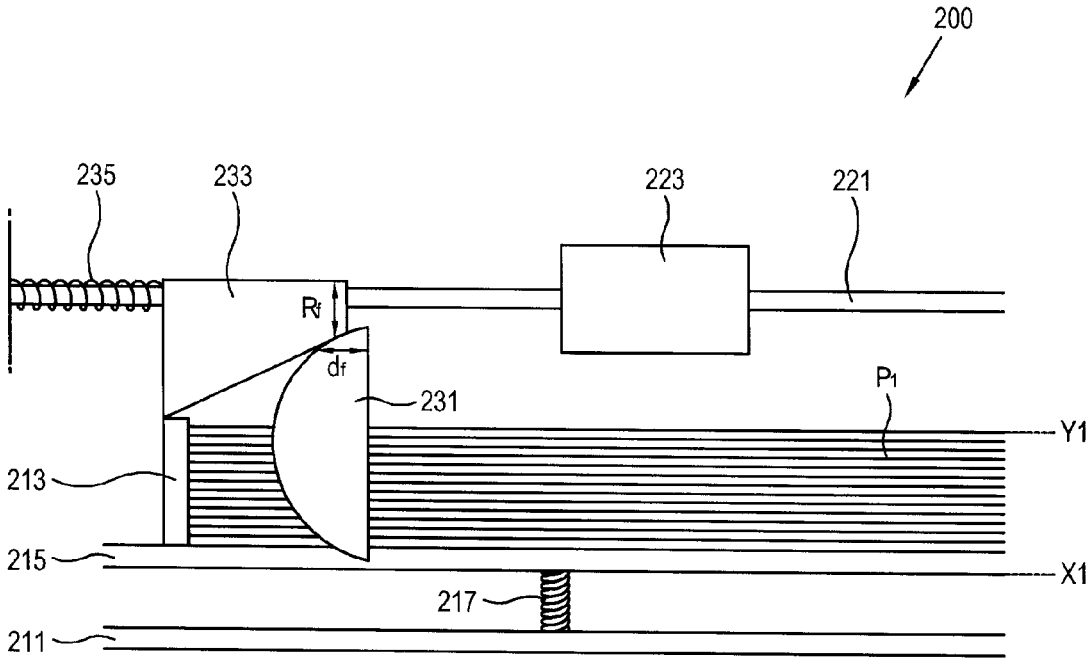
FIGS. 6A and 6B exemplarily illustrate an elevation process of the printing medium supplying unit if a large number of printing mediums are loaded.
Figure 6B:
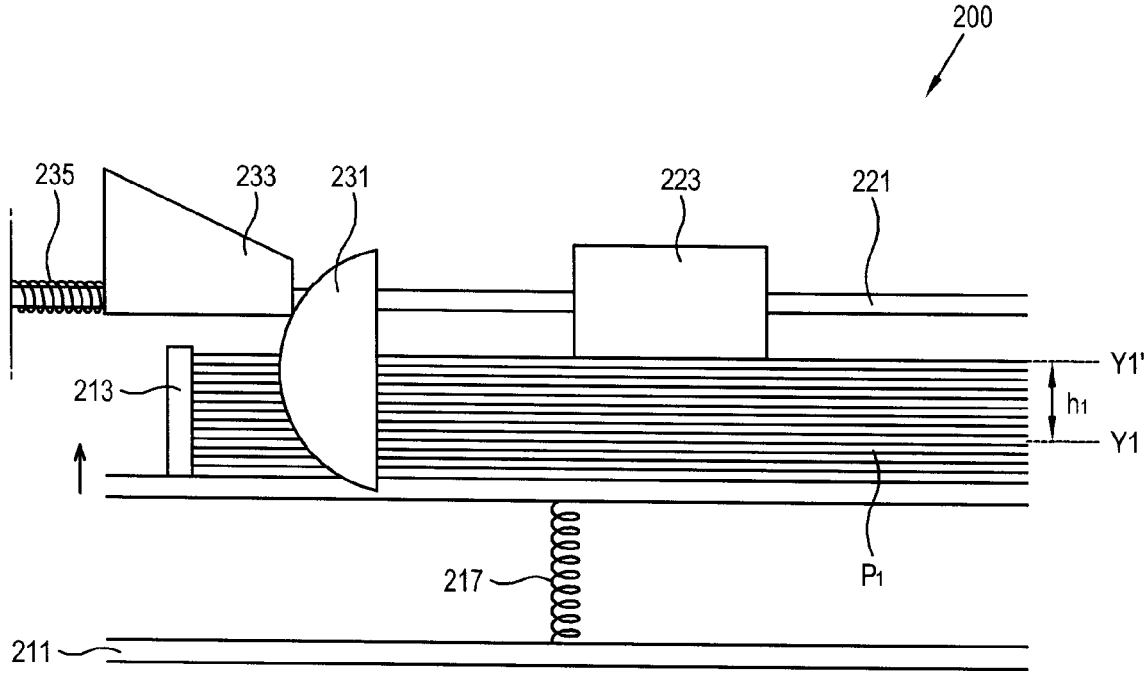

As shown in FIGS. 3A and 6A, in the standby position, the printing medium loading plate 215 moves down toward the cassette main body 211 so that the printing medium loaded in the printing medium loading plate 215 is not in contact with the pickup roller 223. On the other hand, as shown in FIGS. 3B and 6B, in the supply position, the printing medium loading plate 215 moves up so that the printing medium loaded in the printing medium loading plate 215 can be in contact with the pickup roller 223. The height by which the printing medium loading plate 215 moves up and down is the difference between the height of a printing medium positioned in the top in the standby position, and the height which the top-positioned printing medium has in the supply position.

As shown in FIGS. 6A and 6B, the elevation adjusting elastic member 217 is provided between the cassette main body 211 and the printing medium loading plate 215. In an exemplary embodiment, the elevation adjusting elastic member 217 may be configured to apply an elastic force such that the printing medium loading plate 215 moves up. On the other hand, the elevation adjusting elastic member 217 is forced down by the weight of the printing medium loaded in the printing medium loading plate 215. By being forced down, and together with the operation of the elevation control unit 230 as will be further described, the elevation adjusting elastic member 217 maintains the printing medium loading plate 215 in the standby position. In an exemplary embodiment, the elevating adjusting elastic member 217 may be provided as a coil spring (as shown), a leaf spring, or the like.

The pickup unit 220 may be configured to pick up the printing medium from the printing medium loading plate 215 when the printing medium loading plate 215 moves up to the supply position. In an exemplary embodiment, the pickup unit 220 may include a rotation shaft 221 and a pickup roller 223. The rotation shaft 221 may rotate based on an input of a control signal. Specifically, a pickup gear (not shown) may drive the rotation shaft. Additionally, the pickup roller 223 may be coupled to the rotation shaft 221 to pick up the printing medium.

The rotation shaft 221 may be provided to be coaxial with the pickup gear to rotate together with the pickup gear when a driving force is transmitted to the pickup gear. Beneficially, the pickup roller is in contact with a solenoid (not shown), and receives a signal from the solenoid to rotate according to a printing signal applied from a control unit (not shown).

The pickup roller 223 rotates in contact with the top-positioned printing medium loaded in the printing medium loading plate 215. By rotating in contact with the top-positioned printing medium, a frictional force is generated between the pickup roller 223 and the top-positioned printing medium. This frictional force may be used to transfer the top-positioned printing medium from the printing medium loading plate 215 to the pickup roller 223. In an exemplary embodiment, the pickup roller 223 includes an elastic layer 223*a* formed of a material such as, for example, rubber, having a big friction force.

The elevation control unit 230 adjusts the height of the standby position of the printing medium loading plate 215 based on the amount of printing medium loaded on the printing medium loading plate 215. To this end, the elevation control unit 230 includes an external force receiving unit 233, a pressing elastic member 235, and an external force applying unit 231. The external force receiving unit 233 is slidably provided to the rotation shaft 221 of the pickup roller 223. Furthermore, the pressing elastic member 235 elastically presses the external force receiving unit 233 and the external force applying unit 231 coupled to the printing medium loading plate 215. This pressure applied by the pressing elastic member 235 forces the external force receiving unit 233 in a resisting direction against an elastic force of the pressing elastic member 235.

As shown in FIG. 4, the external force receiving unit 233 includes an external force receiving main body 233*a* in contact with the external force applying unit 231, a shaft coupling member 233*c* extending from the external force receiving main body 233*a* to be coupled to the rotation shaft 221, and an elastic member coupling unit 233*d* to which the pressing elastic member 235 is coupled.

The external force receiving main body 233*a* includes an elevation profile 233*b*. This elevation profile 233*b* is provided to the rotation shaft 221 and has a varying maximum diameter R that is in contact with the contact member 213. That is, a contact radius of the external force receiving main body 233*a* varies according to the direction of the rotation shaft 221, and the diameter of the rotation shaft 221.

In an exemplary embodiment, the radius R of the elevating profile 233*b* may decrease continuously from an outer side of the rotation shaft 221 to an inner side. Alternatively, the radius R of the elevating profile 233*b* may decrease discontinuously. For example, the radius R may decrease in steps instead of decreasing continuously.

Figure 7A:
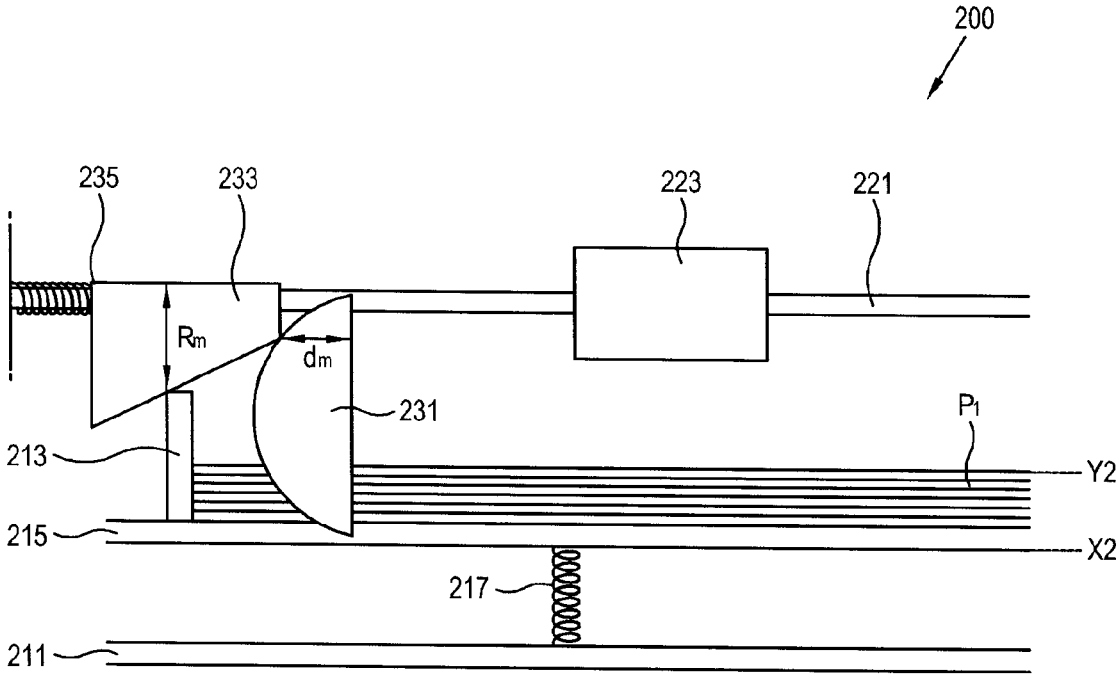
FIGS. 7A and 7B exemplarily illustrate an elevation process of the printing medium supplying unit if a small number of printing mediums are loaded.
Figure 7B:
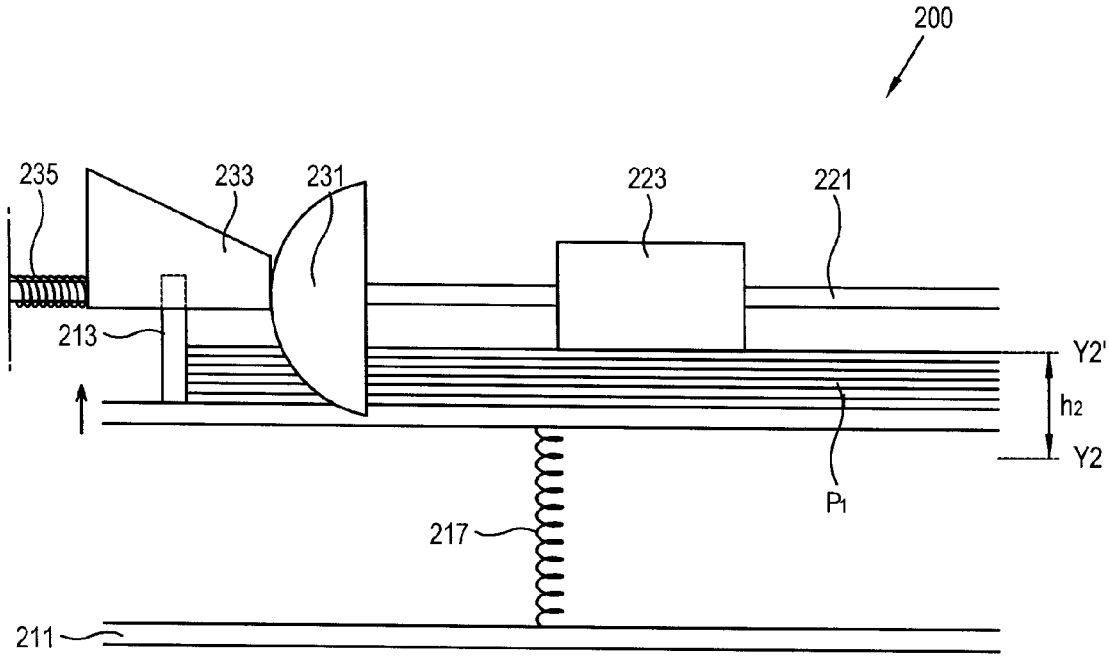

In an exemplary embodiment, the radius R of the external force receiving main body 233*a* may determine the standby position of the printing medium loading plate 215. The standby position of the printing medium loading plate 215 is determined depending on a contact position of the elevation profile 233*b* with the contact member 213. Accordingly, the elevation height of the printing medium loading plate 215 is determined based on the contact position of the elevation profile 233*b* with the contact member 213. That is, as shown in FIG. 6A, if the radius R of the elevating profile 233*b* is maximum, the standby position of the printing medium loading plate 215 is provided to a position adjacent to the cassette main body 211. On the other hand, as shown in FIG. 7A, if the radius R of the elevating profile 233*b* decreases, the standby position of the printing medium loading plate 215 moves up further towards the pickup roller 223 as compared with the case shown in FIG. 6A. Thus, as there is movement from the outer side of the elevating profile 233*b* to the inner side thereof along the rotation shaft 221, the height of the standby position of the printing medium loading plate 215 gradually increases.

Figure 5:
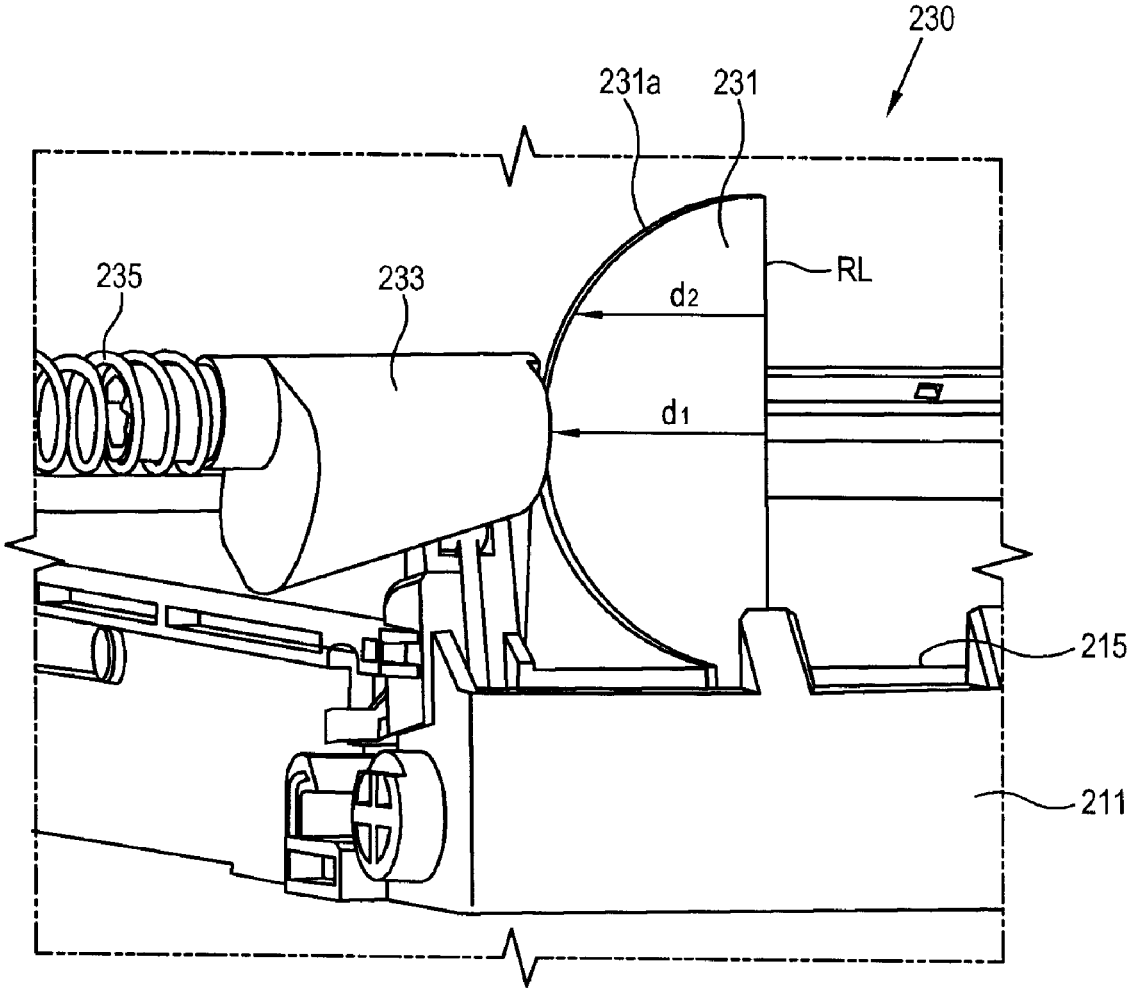
FIG. 5 is a perspective view illustrating a configuration of an elevation control unit according to an exemplary disclosed embodiment.

The external force receiving main body 233*a* is provided to slide on the rotation shaft 221. Furthermore, a rotation shaft accommodating hole 233*e* is formed through the external force receiving main body 233*a*. The rotation shaft accommodating hole 233*a* has an inner diameter bigger than a diameter of the rotation shaft 221. As shown in FIG. 5, the external force receiving main body 233*a* moves horizontally along the rotation shaft 221 based on the interplay between the external force applying unit 231 and the pressing elastic member 235.

The pressing elastic member 235 applies an elastic force to the external force receiving unit 233 so that an increasing area of the external force receiving main body 233*a* can come in contact with the contact member 213. That is, as shown in FIG. 5, the pressing elastic member 235 applies an elastic force so that the external force receiving unit 233 can move toward the external force applying unit 231.

As discussed above, the external force applying unit 231 is pressed by the external force receiving unit. Consequently, the external force applying unit 231 applies a reactionary external force to the external force receiving unit 233. Upon receiving such a force from the external force applying unit 231, the external force receiving unit 233 presses the printing medium loading plate 215. In an exemplary embodiment, the external force applying unit 231 may be provided as an adjusting cam that presses in contact with the external force receiving unit 233. Alternatively, the external force applying unit 231 may be a solenoid that adjusts the position of the external force receiving unit 233 based on receipt of a control signal.

As disclosed in FIG. 5, the external force applying unit 231 according to an exemplary disclosed embodiment may be an adjusting cam. In addition, the external force applying unit 231 includes an adjusting profile 231*a*. As shown in FIG. 5, the adjusting profile 231*a* is shaped such that the distance between the line RL and the external force receiving unit 233 varies along the length of line RL. Also, the external force applying unit 231 is fixedly coupled to the printing medium loading plate 215 to move up and down together with the printing medium loading plate 215, which moves up and down between the standby position and the supply position.

Figure 8A:
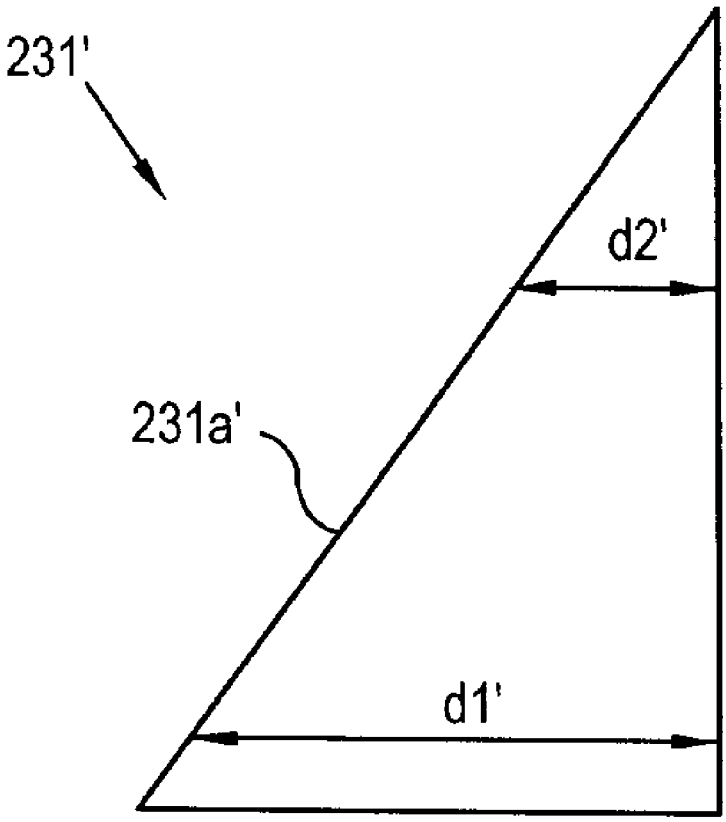
FIGS. 8A and 8B illustrate an external force applying unit according to an alternative exemplary disclosed embodiment.
Figure 8B:
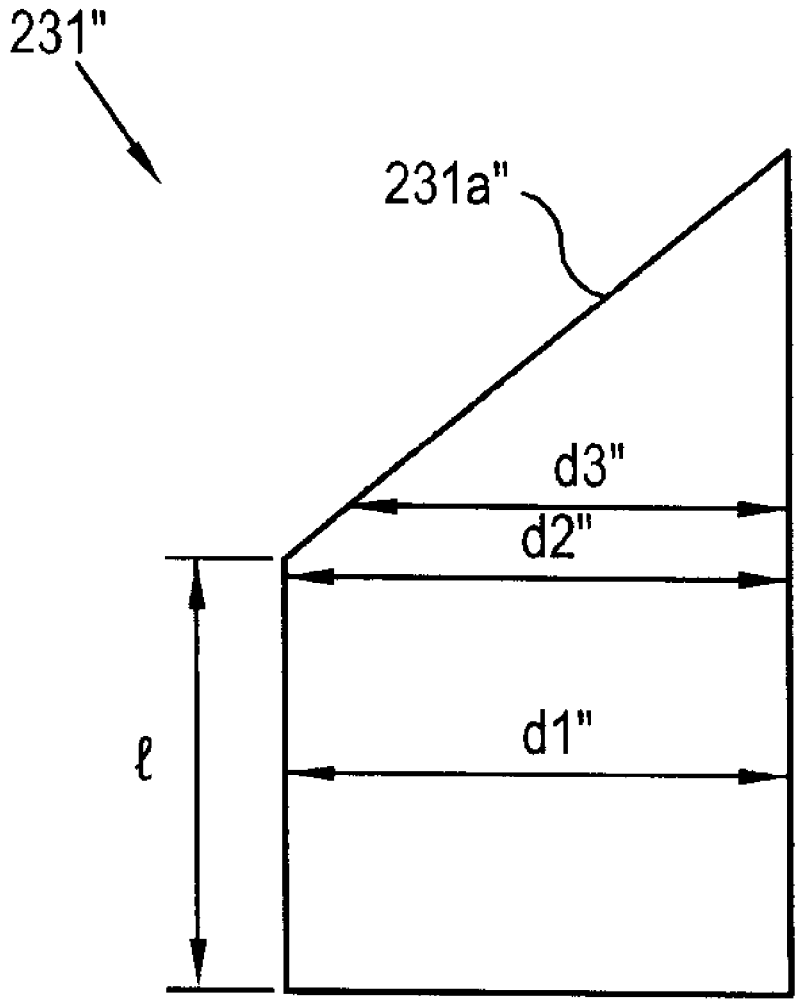

As shown in FIG. 5, the distance between line RL and the external force receiving unit 233 may increase moving from the upper portion of the external force applying unit 231 towards the middle portion of the external force applying unit (d1>d2). In an alternative exemplary embodiment, as shown in FIG. 8A, the external force applying unit 231' may be shaped differently to have a different adjusting profile 231*a*'. Specifically, as shown in FIG. 8A, the distance between line RL and the external force receiving unit 233 may decrease and become smaller from a lower part to an upper part (d1'>d2'). In yet another alternative exemplary embodiment, as shown in FIG. 8B, the adjusting profile 231*a*" may be different than 231*a* of FIG. 5 and 231*a*' of FIG. 8A. As seen in FIG. 8B, the adjusting profile 231*a*" may be provided so that a predetermined height in a lower part (l) can have a uniform contact length and the contact length over length l can gradually decrease (d1"=d2">d3").

The pressing elastic member 235 causes the external force receiving unit 233 to come in contact with the external force applying unit 233. Furthermore, the contact length d of the external force applying unit 233 determines the horizontal distance the external force receiving unit 233 moves when the external force receiving unit 233 is in contact with the external force applying unit 231. The distance the external force receiving unit 233 moves determines the contact position of the external force receiving unit 233 with the printing medium loading plate 215. Additionally, as already discussed above, the radius R of the elevation profile 233*b* of the external force receiving main body varies along the length of the external force receiving unit 233. This variation in the radius R coupled with the distance the external force receiving unit 233 actually moves determines the amount by which the printing medium loading plate 215 is actually pressed.

An operating process of the printing medium supplying unit 200 according to an exemplary disclosed embodiment will now be described by referring to FIGS. 3A to 7B. At first, as shown in FIG. 6A, if a large number of printing mediums are loaded in the printing medium loading plate 215, the elevation adjusting elastic member 217 contracts due to the weight of the printing medium. This contraction of the elevation adjusting elastic member 217 causes the printing medium loading plate 215 to move down towards the cassette main body 211.

As seen in FIG. 6A, the external force receiving unit 233 comes in contact with an upper part of the external force applying unit 231. Specifically, the external force receiving unit 233 is in contact with the adjusting profile 231 a having a short contact length d. Furthermore, the pressing elastic member 235 exerts an elastic force to cause the external force applying unit 231 to move towards the pickup roller 223. Also, the contact member 213 comes in contact with a point of the external force receiving unit 233 having a big contact radius R. Accordingly, the standby position of the printing medium loading plate 215 is a position X adjacent to the cassette main body 211, and the height of the top-positioned printing medium is a position Y.

In this state, as shown in FIG. 6B, if a printing signal is applied, the rotation shaft 221 rotates, the external force receiving unit 233 rotates together with the rotation shaft 221, and a pressing force pressing the contact member 213 is withdrawn. The printing medium loading plate 215 elastically moves up depending on the withdrawal of the pressing force. Here, the supply position of the printing medium loading plate 215 becomes a position Y1'. At position Y1', the top-positioned printing medium comes in contact with the pickup roller 223. At this time, the elevation height of the printing medium loading plate 215 becomes a height difference h1 of the top-positioned printing medium.

On the other hand, as shown in FIG. 7A, if the loading amount of the printing medium loaded in the printing medium loading plate 215 is further reduced than the case shown in FIG. 6A, the printing medium loading plate 215 has a relatively high standby position (X2>X1). That is, the contact length dm of the external force applying unit 231 pressing the external force receiving unit 233 toward the pressing elastic member 235 becomes bigger (dm>df) than the case shown in FIG. 6A as the height of the printing medium loading plate 215 increases. This increase in contact length dm pressing the external force receiving unit 233 causes the external force receiving unit 233 to move towards the pressing elastic member 235. This movement of the external force receiving unit 233 towards the pressing elastic member 235 causes the contact diameter Rm of the elevation profile 233*b* of the external force receiving unit 233 that presses the contact member 213 to become shorter (Rm<Rf) than the case shown in FIG. 6A. Because the contact diameter Rm becomes shorter, the height of the standby position of the printing medium loading plate 215 can increase (X2>X1).

If the printing signal is applied, the rotation shaft 221 rotates, and the pressing force of the external force receiving unit 233 pressing the contact member 213 is withdrawn. The printing medium loading plate 215 moves up to the supply position in which the top-positioned printing medium comes in contact with the pickup roller 223. In this case, the elevation height of the printing medium loading plate 215 becomes smaller than the case shown in FIG. 6B, in which a large number of printing mediums are loaded. However, the elevating height of the top positioned printing medium loading plate 215 is substantially the same as the case shown in FIG. 6B (h1≈h2).

Accordingly, in the printing medium supplying unit 200 disclosed above, although the elevating height of the printing medium loading plate 215 is gradually reduced as the loading amount of the printing medium decreases, the elevation height of the top positioned printing medium can be maintained to be the substantially same. Thus, when the printing medium loading plate 215 moves up and down, because the top-positioned printing medium moves by the same elevation height irrespective of the loading amount of the printing medium, an impact noise can be uniform. Also, because the top-positioned printing medium moves up and down by the same distance as would be the case where the elevation height was the least, (i.e., a lot of printing mediums are loaded), the generated impact noise can be minimized.

As discussed above, in the printing medium supplying unit 200, the standby position and the supply position of the printing medium loading plate 215 vary depending on the loading amount of the printing medium. Specifically, these positions are maintained when the elastic force of the elevating adjusting elastic member 217 elastically supporting the printing medium loading plate 215 and the elastic force of the pressing elastic member 235 balance each other. Accordingly, in designing the printing medium supplying unit 200, the elastic forces of the elevating adjusting elastic member 217 and the pressing elastic member 235 may be determined based on factors such as, for example, the shapes of the elevating profile 233*b* and the adjusting profile 231*a* and a maximum loading amount of the printing medium loaded in the printing medium loading plate 215.

Figure 9:
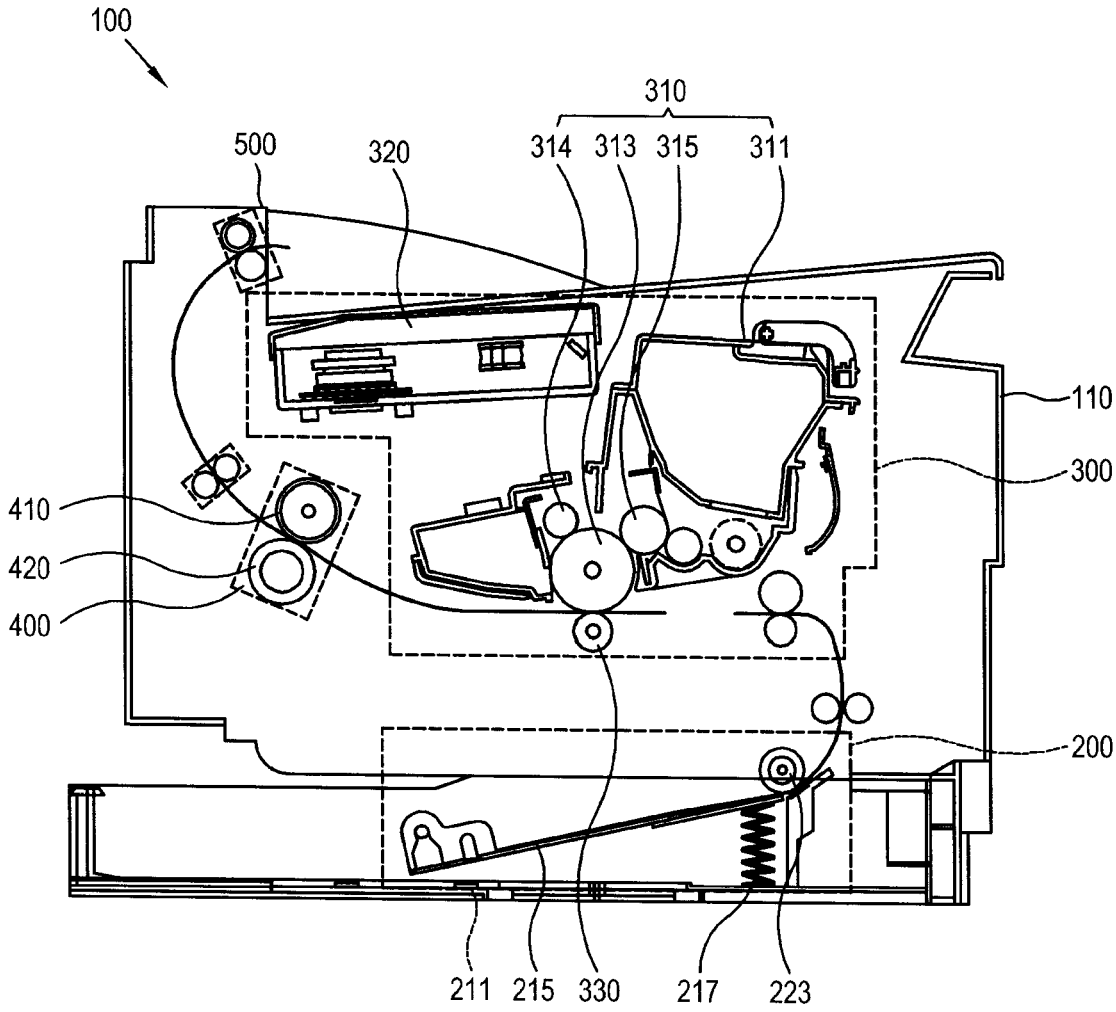
FIG. 9 is a schematic view illustrating a configuration of an image forming apparatus employing the printing medium supplying unit according to an exemplary disclosed embodiment.

FIG. 9 is a schematic view illustrating a configuration of an image forming apparatus 100 including the printing medium supplying unit 200 according to an exemplary disclosed embodiment. As shown in FIG. 9, the image forming apparatus 100 includes the printing medium supplying unit 200, an image forming unit 300, a fusing unit 400, and a discharging unit 500. The image forming unit is configured to form an image on a printing medium. The fusing unit 400 is configured to fuse the image on the printing medium. The discharging unit 500 is configured to discharge the printing medium on which the image is completely formed to the outside.

Specifically, the image forming unit 300 applies a developer to the printing medium picked up by the pickup roller 223 to form an image. The fusing unit 400 applies heat and pressure to the printing medium to fuse the developer on the printing medium. The discharging unit 500 discharges the printing medium passing through the fusing unit 400 to an external unit that is configured to receive the printing medium with the image formed on the printing medium.

The printing medium supplying unit according to an exemplary disclosed embodiment may be mounted below the image forming apparatus. Alternatively, the disclosed printing medium supplying unit may be provided to a large sized printing apparatus that is commonly used to print advertising material, wall paper, etc.

As described above, the present disclosure provides a printing medium supplying unit and an image forming apparatus having the same, that is capable of gradually raising a standby position of a printing medium loading plate as a loading amount of a printing medium decreases. This gradual raising of the standby position of the printing medium loading plate may help maintain an elevation height of the printing medium loading plate to be uniform. This operation may also help reduce an impact noise and/or impact damage generated when the printing medium is supplied to the image forming unit.

Although a few exemplary embodiments of the present disclosure have been shown and described, it will be appreciated by those skilled in the art that changes may be made in these exemplary embodiments without departing from the principles and spirit of the disclosure, the scope of which is defined in the appended claims and their equivalents.

What is claimed is:

1. A printing medium supplying unit, comprising:

a printing medium loading plate configured to move up and down, and to hold thereon an amount of printing medium;

a rotation shaft;

a pickup roller disposed on the rotation shaft; and an elevation control unit configured to adjust an elevation height of the printing medium loading plate such that a standby position of the printing medium loading plate varies based on the amount of the printing medium loaded on the printing medium loading plate, the elevation control unit including:

an external force receiving unit configured to press and release the printing medium loading plate such that the printing medium loading plate moves up and down between the standby position and a supply position, the external force receiving unit being coupled to the rotation shaft and having a contact radius that varies in an axial direction of the rotation shaft; and an external force applying unit configured to apply an external force to the external force receiving unit to adjust a position in which the external force receiving unit presses the printing medium loading plate, wherein the standby position of the printing medium loading plate is a position of the printing medium loading plate in which the printing medium is not being supplied from the printing medium supplying unit, and the supply position of the printing medium loading plate is a position of the printing medium loading plate in which the printing medium loading plate supplies the printing medium to an image forming unit.

2. The printing medium supplying unit according to claim 1, wherein the contact radius varies continuously.

3. The printing medium supplying unit according to claim 1, wherein the contact radius varies discontinuously.

4. The printing medium supplying unit according to claim 1, wherein the elevation control unit further comprises an elastic member, the elastic member being configured to elastically press the external force receiving unit towards the external force applying unit.

5. The printing medium supplying unit according to claim 1, wherein the external force applying unit comprises a cam member.

6. The printing medium supplying unit according to claim 5, wherein the cam member moves up and down together with the printing medium loading plate.

7. The printing medium supplying unit according to claim 6, wherein the cam member comprises an adjusting profile which has a varying contact distance from the external force receiving unit with respect to a reference line vertical to a rotation shaft of a pickup roller.

8. The printing medium supplying unit according to claim 7, wherein the adjusting profile is provided so that the contact distance can be reduced from a lower side of the reference line to an upper side thereof.

9. The printing medium supplying unit according to claim 7, wherein the printing medium loading plate comprises a contact member which is configured to be pressed or released depending on a position the external force receiving unit.

10. An image forming apparatus, comprising:

a printing medium supplying unit including:

a printing medium loading plate configured to move up and down, and to hold thereon a printing medium;

a rotation shaft;

a pickup roller disposed on the rotation shaft; and an elevation control unit configured to adjust an elevation height of the printing medium loading plate such that a standby position of the printing medium loading plate varies based on an amount of the printing medium loaded on the printing medium loading plate, the elevation control unit including:

an external force receiving unit configured to press and release the printing medium loading plate such that the printing medium loading plate moves up and down between the standby position and a supply position, the external force receiving unit being coupled to the rotation shaft and having a contact radius that varies in an axial direction of the rotation shaft; and an external force applying unit configured to apply an external force to the external force receiving unit to adjust a position in which the external force receiving unit presses the printing medium loading plate, an image forming unit configured to form an image on a the printing medium supplied from the printing medium supplying unit; and a printing medium discharging unit configured to discharge the printing medium on which the image is formed, wherein the standby position of the printing medium loading plate is a position of the printing medium loading plate in which the printing medium is not being supplied from the printing medium supplying unit, and the supply position of the printing medium loading plate is a position of the printing medium loading plate in which the printing medium loading plate supplies the printing medium to the image forming unit.

11. The image forming apparatus according to claim 10, wherein the external force applying unit comprises a cam member.

12. The image forming apparatus according to claim 11, wherein the cam member comprises an adjusting profile which has a varying contact distance from the external force receiving unit with respect to a reference line vertical to a rotation shaft of a pickup roller.

13. The image forming apparatus according to claim 12, wherein the adjusting profile is provided so that the contact distance can be reduced from a lower side of the reference line to an upper side thereof.

14. The image forming apparatus according to claim 10, wherein the printing medium loading plate comprises a contact member which is configured to be pressed or released depending on a position of the external force receiving unit.

15. The image forming apparatus according to claim 10, wherein the contact radius varies continuously.

16. The image forming apparatus according to claim 10, wherein the contact radius varies discontinuously.

17. The image forming apparatus according to claim 10, wherein the elevation control unit further comprises an elastic member, the elastic member being configured to elastically press the external force receiving unit towards the external force applying unit.

18. The image forming apparatus according to claim 12, wherein the cam member moves up and down together with the printing medium loading plate.

19. The image forming apparatus according to claim 13, wherein the printing medium loading plate comprises a contact member which is configured to be pressed or released depending on a position the external force receiving unit.

* * * * *